US007037407B2

(12) United States Patent
Koivukunnas et al.

(10) Patent No.: US 7,037,407 B2
(45) Date of Patent: May 2, 2006

(54) METHOD AND CALENDER FOR CALENDERING A PAPER WEB ABOVE THE GLASS TRANSITION RANGE OF THE PAPER

(75) Inventors: Pekka Koivukunnas, Järvenpää (FI); Kaj Fabritius, Hyvinkää (FI)

(73) Assignee: Metso Paper, Inc., Helsinki (FI)

( * ) Notice: Subject to any disclaimer, the term of this patent is extended or adjusted under 35 U.S.C. 154(b) by 137 days.

(21) Appl. No.: 10/474,886

(22) PCT Filed: Apr. 16, 2002

(86) PCT No.: PCT/FI02/00319

§ 371 (c)(1),
(2), (4) Date: Apr. 30, 2004

(87) PCT Pub. No.: WO02/084022

PCT Pub. Date: Oct. 24, 2002

(65) Prior Publication Data

US 2004/0173331 A1 Sep. 9, 2004

(30) Foreign Application Priority Data

Apr. 17, 2001 (FI) ..... 20010788

(51) Int. Cl.
*D21F 11/00* (2006.01)
*D21J 1/04* (2006.01)

(52) U.S. Cl. ..... 162/205; 162/206; 162/207; 100/38; 100/93 RP; 100/35; 100/161

(58) Field of Classification Search ..... 162/205, 162/206, 207; 100/38, 93 RP, 35, 161
See application file for complete search history.

(56) References Cited

U.S. PATENT DOCUMENTS

| | | | |
|---|---|---|---|
| 4,606,264 | A | 8/1986 | Agronin et al. |
| 5,137,678 | A | 8/1992 | Hess et al. |
| 5,245,920 | A | 9/1993 | Hess |
| 5,318,670 | A | 6/1994 | Link et al. |
| 5,524,532 | A | 6/1996 | Koivukunnas et al. |
| 6,779,440 | B1 | 8/2004 | Pekka et al. |

FOREIGN PATENT DOCUMENTS

| | | |
|---|---|---|
| FI | 98230 | 5/1997 |
| WO | WO 01/59211 A1 | 8/2001 |
| WO | WO 01/98585 A1 | 12/2001 |
| WO | WO 02/084022 A1 | 10/2002 |

OTHER PUBLICATIONS

International Preliminary Examination Report issued in PCT/FI02/00319, d. Jul. 2003.
"Temperature-gradient calendering", by R.H. Crotogino, Tappi Journal, Oct. 1982, pp. 97-101.
International Search Report issued in PCT/FI02/00319, d. Aug. 2002.
"The Present State of Press-Drying Paper" Back, Ernst L., 1983; London; Mechanical Engineering Publications, Ltd.

*Primary Examiner*—Mark Halpern
(74) *Attorney, Agent, or Firm*—Stiennon & Stiennon

(57) ABSTRACT

A paper web is calendered by passing the paper web through a nip formed by a heatable thermo roll and a backing roll. The surface temperature of the thermo roll is above the glass transition range of the paper.

5 Claims, No Drawings

METHOD AND CALENDER FOR CALENDERING A PAPER WEB ABOVE THE GLASS TRANSITION RANGE OF THE PAPER

CROSS REFERENCES TO RELATED APPLICATIONS

This application is a U.S. National Stage Application of International Application No. PCT/FI02/00319, filed Apr. 16, 2002, and claims priority on Finnish Application No. 20010788, Filed Apr. 17, 2001.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to calendering of paper and to a method, wherein a paper web is passed through a nip formed by a heatable thermo roll and a backing roll.

In calendering, paper is pressed in the nip, whereby the surface of the paper in particular is moulded under the effect of mechanical work and heat. The purpose is to increase especially the smoothness of the paper, and to eliminate variations in thickness. However, in calendering, the paper is also compressed, which decreases the stiffness, the strength, and the opacity.

The plasticity of paper in calendering can be improved by increasing the temperature of the paper. In practice, this is effected so that one of the rolls of the nip is a heatable roll, a so-called thermo roll, which is against the surface of the web that is to be moulded. In the calendering methods used at present, the surface temperature of the thermo roll is in the range of the glass-transition temperature of the paper that is moulded, at the most. The glass-transition temperature is dependent on the paper grade. Moisture decreases the glass-transition temperature, which is why the paper is often moistened before calendering. Typically, the glass-transition temperature is within 150 to 250° C.

SUMMARY OF THE INVENTION

A paper web is calendered by passing the paper web through a nip formed by a heatable thermo roll and a backing roll. The surface temperature of the thermo roll is above the glass transition range of the paper.

BRIEF DESCRIPTION OF THE DRAWINGS

Not applicable.

DESCRIPTION OF THE PREFERRED EMBODIMENTS

Paper herein generally refers to a web-like material, which is manufactured of a fibre suspension. Thus, the paper can be actual paper, for example, such as printing paper, or paperboard.

The roll herein generally refers to a rotating member, such as a rotating roll and/or a revolving belt.

Paper that is manufactured of wood fibre contains various polymers: cellulose, hemicellulose, and lignin. In addition, coated paper can also contain other polymers, such as starch or synthetic polymers, such as polystyrene butadiene. The polymers are partly in a crystalline and partly in an amorphous form. The deformations that take place in the polymers of the paper depend on time and are partly non-reversible (visco-elastic). The macroscopic deformation of a visco-elastic material is a result of deformation processes on the molecular level. An increase in temperature accelerates the movement of the molecules and their segments and makes the amorphous phase quicker in reacting to an external force. In that case, as large permanent deformations can be achieved in the material by means of an external force of a shorter duration.

Below a certain temperature range characteristic to each polymer, the glass transition temperature range, the amorphous phase is in a glassy state. Hereby amorphous polymers and the amorphous parts of partly crystalline polymers have solidified and become hard and fragile. However, under an external force, in addition to the reversible deformation (an elastic component) in the glassy state, also permanent deformation (a viscous component) can take place, which is called plastic deformation. In the glass transition range, the portion of the viscous component of the amorphous phase increases considerably and all physical and mechanical properties undergo a strong change. The centre of the range is called the glass transition temperature.

Depending on the degree of crystallinity, the glass transition temperature of the cellulose in wood fibres is about 200–250° C., that of hemicellulose about 150–220° C., and that of lignin about 130–205° C. The glass transition temperatures of the synthetic polymers normally used in coatings are considerably lower than those of the biopolymers contained in wood fibres. For example, the glass transition temperature of styrene/butadiene latex, depending on the structure of the bond of the polymer, is about 0–70° C. The glass transition temperature of starch in dry conditions is about 100° C. The glass transition temperature is dependent on the plasticizing effect of water. A growth in moisture content decreases the glass transition temperature.

Above the glass transition range, there is the range of a rubbery state. With the temperature further increasing, a rubbery flow range is reached and, further, a viscous flow range.

In the method now invented, paper is calendered in the nip by a thermo roll, the surface temperature of which is above the glass transition range of the paper to be calendered, i.e. in the range of the rubbery state, in the rubbery flow range or in the viscous flow range. Correspondingly, the temperature can be, for example, about 250° C. at a minimum, about 300° C. at the minimum or about 350° C. at the minimum. A temperature of as much as 450° C. can be used. The upper limit should be about 550° C. The temperature is preferably within 300–400° C. At the temperatures according to the invention, the fibres of the surface are plasticized, whereby they are easier to mould, for example, to press into a flat form. The deformations are also more stable than at lower temperatures. At high temperatures, the surface of the paper can partly melt. Because of the plasticizing of the surface, moulding in the direction of the surface, such as a transition, increases.

The method according to the invention gives better smoothness, polish, and consistency to the surface of the paper. In that case, for example, the printability of the paper improves, because the printing ink sticks better to the surface. For coated grades, the amount of coating needed is reduced.

When so desired, the surface of the paper can also be moistened before the calendering nip to improve the plasticity. At temperatures according to the invention, however, moistening is generally not needed.

When so desired, the paper can be cooled after the nip.

Because the surface of the paper is easier to mould in the nip, lower nip pressures and shorter residence times can be used. In this way, particularly the compression of the paper decreases and the volume weight (bulk) is better maintained.

The calender can be a soft calender, for example. The calender can also be a multi-nip calender. In a traditional calender formed by two round rolls, the linear load can be 40–200 kN/m, for example. The calendering nip is preferably a so-called long nip, a revolving belt being provided at least on its one side, moving in the nip over a so-called shoe, wherein the other nip surface presses it. The distance travelled by the paper web in the nip can be, for example, 25–400 mm, such as 150–250 mm. The nip pressure can be 5–50 Mpa, such as 10–30 Mpa, for example, depending on the belt coating and the linear load. The residence time in the nip can be short.

The temperature of the paper web coming to the nip can be 30–100° C., for example. Generally, it is the better the lower the inner temperature of the paper is, as in that case there is less compression of the inner part of the paper. The other surface of the paper can be cooled. The formation of a temperature gradient in the calendering nip is influenced by transfer of heat from the thermo surface to the paper, transfer of heat inside the paper, and by transfer of heat from the backside to the counter surface. The compression pressure has a considerable effect on the heat transfer.

Moulding of the inner part of the paper can further be decreased by cooling the web surface on the side of the backing roll.

The method can be applied to both coated and uncoated paper and to both precalendering and finishing calendering. In precalendering, the intention is to particularly control the degree of roughness and porosity required by the coating.

The high temperature needed is best provided by means of oil or induction heating.

The invention claimed is:

1. A method for calendering of paper, comprising the steps of:

passing a paper web through a nip formed by a heatable thermo roll and a backing roll, the web having a first side which engages the thermo roll, and a second side which engages the backing roll, and an inner part therebetween, wherein the surface temperature of the thermo roll is above the glass transition range of the paper, and the thermo roll temperature is between 300° C. and 550° C.;

cooling the second side in the nip by engagement with the backing roll so as to prevent moulding of the inner part of the paper web.

2. The method of claim 1, wherein the temperature of the thermo roll is between 300° C. and 450° C.

3. The method of claim 1, wherein the temperature of the thermo roll is at least about 350° C.

4. A calender comprising:

a thermo roll having a surface with a temperature of between 300° C. and 550° C.;

a backing roll forming a nip with the thermo roll;

a paper web passing through the nip having a first side engaging the thermo roll, a second side engaging the backing roll, and an inner part therebetween; and a means for preventing moulding of the inner part by cooling the second side of the paper web, positioned to cool the second side of the paper web.

5. The calender of claim 4, wherein the temperature of the thermo roll is at least about 350° C.

* * * * *